United States Patent [19]

Deutsch et al.

[11] Patent Number: 4,971,078

[45] Date of Patent: Nov. 20, 1990

[54] FILTER FOR A SMOKING ARTICLE CONTAINING A FLAVORED HOLLOW FIBER

[75] Inventors: Lance J. Deutsch; Cheryl E. Johnson, both of Charlotte, N.C.

[73] Assignee: Hoechst Celanese Corporation, Somerville, N.J.

[21] Appl. No.: 394,341

[22] Filed: Aug. 15, 1989

[51] Int. Cl.[5] ..... A24D 3/04

[52] U.S. Cl. ..... 131/335; 131/339; 131/344

[58] Field of Search ..... 131/335, 275, 339, 336, 131/344

[56] References Cited

U.S. PATENT DOCUMENTS

| | | | |
|---|---|---|---|
| 3,144,024 | 8/1964 | Eichwald | 131/275 |
| 3,890,983 | 6/1975 | Sawada et al. . | |
| 3,951,155 | 4/1976 | Prouse et al. . | |
| 4,005,718 | 2/1977 | Prouse et al. . | |
| 4,007,746 | 2/1977 | Sawada et al. . | |
| 4,085,760 | 4/1978 | Toyoshima et al. . | |
| 4,211,741 | 7/1980 | Ostoich . | |
| 4,292,984 | 10/1981 | Sawada et al. . | |
| 4,700,724 | 10/1987 | Horsewell et al. | 131/339 |
| 4,714,082 | 12/1987 | Banerjee et al. . | |
| 4,729,391 | 3/1988 | Woods et al. . | |
| 4,744,932 | 5/1988 | Browne . | |
| 4,754,766 | 7/1988 | Luke et al. . | |

OTHER PUBLICATIONS

"Filtrona Flavour Thread Filters"-Filtrona Ltd.

*Primary Examiner*—V. Millin

*Attorney, Agent, or Firm*—Robert H. Hammer III

[57] ABSTRACT

A filter for a smoking article includes: a flavorant; a hollow fiber made of a thermoplastic, the flavorant dispersed in the thermoplastic; and a filter plug in which the fiber is embedded. Additionally, the hollow fiber may be sheathed with a layer of cellulose acetate.

12 Claims, 1 Drawing Sheet

FILTER FOR A SMOKING ARTICLE CONTAINING A FLAVORED HOLLOW FIBER

FIELD OF THE INVENTION

A filter for a smoking article, e.g. a cigarette, contains a hollow fiber which is impregnated with flavorants.

BACKGROUND OF THE INVENTION

Numerous ways of flavoring the smoke of a smoking article are known. For example, in U.S. Pat. No. 4,729,391, microporous particles that are impregnated with a flavorant are added to a cigarette filter. In another example, a flavored thread, made of a thermoplastic, is placed coaxially within the filter plug. In yet another example, a skinless hollow fiber of cellulose acetate can be used to flavor tobacco smoke. See U.S. Pat. No. 4,744,932. None of these methods, however, have obtained wide commercial acceptance.

In commercially available mentholated smoking articles, either the tobacco shred, the filter plug, or the inner wrapper of the smoking article package is flavored. A principle drawback of these methods is that the smoking article will not stay flavored for extended periods of time after the pack is opened. Thus, the flavorant must be added in greater amounts to achieve acceptable levels of flavor when the article is smoked. Flavorants are expensive and these high rates of addition make the flavored smoking article more expensive.

Smoking product manufacturers are also looking at the use of flavorants other than menthol. These other flavorants are used to reduce the after taste of the article. Therefore, even greater amounts of expensive flavorants may be used and thereby drive the cost of smoking articles even higher.

Accordingly, there is a need for a method of storing flavorants in a smoking article which will reduce the amount of flavorant needed, yet deliver a good level of flavorant to the smoker when the article is puffed.

SUMMARY OF THE INVENTION

A filter for a smoking article comprises: a flavorant; a hollow fiber made of a thermoplastic, the flavorant dispersed in the thermoplastic; and a filter plug in which the fiber is embedded.

The use of flavored hollow fibers in such filters is advantageous over the prior art because the flavorants are less likely to evaporate from the hollow fiber during storage, yet the hollow fibers have a large surface area for contact with the smoke of the smoking article and channel more smoke through the lumen of the fiber because of its lower pressure drop, thereby providing good release of flavorant from the hollow fiber.

DESCRIPTION OF THE DRAWINGS

For the purpose of illustrating the invention, there is shown in the drawings a form which is presently preferred; it being understood, however, that this invention is not limited to the precise arrangement and instrumentality shown.

DETAILED DESCRIPTION OF THE INVENTION

Figure 1:
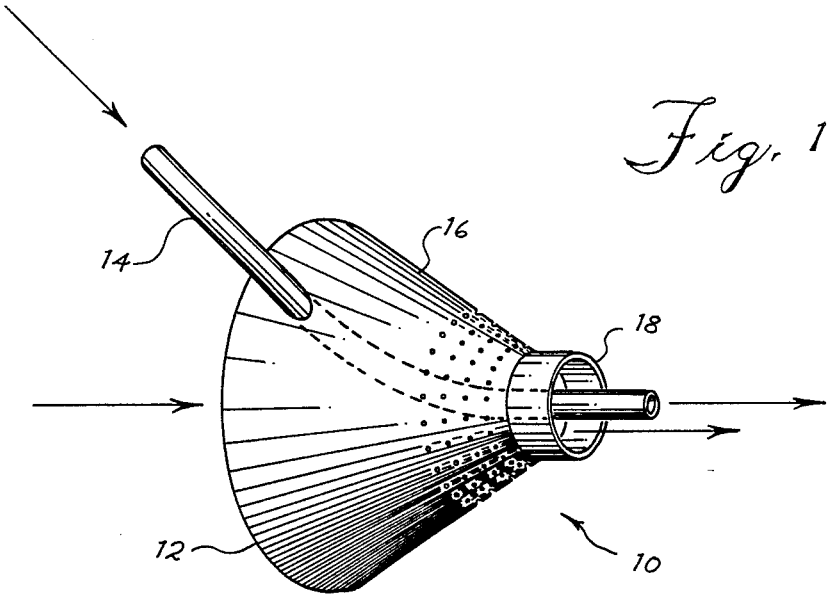
FIG. 1 is a modified funnel used with a conventional filter rod making machine for the insertion of hollow fiber into the filter rod.

The present invention is directed to a filter for a smoking article which incorporates a flavored hollow fiber made of a thermoplastic material. The flavorants are impregnated within the thermoplastic material. Additionally, the hollow fiber may be sheathed with a layer of cellulose acetate.

The hollow fiber is made from a thermoplastic material. Suitable thermoplastic materials include polyolefins, polyesters and polycarbonates, and exclude cellulose acetate. Polyethylene is a preferred thermoplastic. The dimensions of the thermoplastic hollow fiber are about 0.02–0.15 inches outside diameter (O.D.) with a wall thickness of about 0.005–0.025 inches.

The thermoplastic of the hollow fiber is impregnated with a flavorant. The flavorant is preferably preblended with the thermoplastic material, but it does not have to be pre-blended. The flavorants typically have a concentration range of about 5–25% by weight in the thermoplastic. Suitable flavorants include menthol, spearmint, peppermint, cocoa, vanilla, cinnamon, licorice, citrus, other fruit flavors, and tobacco. Such flavorants and flavorants blended with thermoplastics are commercially available from such companies as International Flavors and Fragrances, Inc. (IFF) of New York City, N.Y. and AFT, Inc. of Hammonton, N.J.

The choice of the thermoplastic material is preferred over cellulose acetate because the flavorants have a greater solubility in the thermoplastic material than in cellulose acetate. Accordingly, the flavorants are not as easily released from the thermoplastic material and therefore have a greater shelf life. Release of flavorants from the thermoplastic material is controlled not only by diffusion, but by solubility as well.

In theory, the flavorants dissolve into the thermoplastic to a greater extent than they would into cellulose acetate. Therefore, the release of flavorants is not controlled solely by diffusion, but it is controlled by a combination of solubility and diffusion. This combined release mechanism slows the release of flavorant from the hollow fiber. The slower release, however, does not adversely affect the release of the flavorant during smoking. Prior to smoking, the flavorant is released into the lumen of the hollow fiber and comes into equilibrium with the flavorant dissolved in the thermoplastic. This equilibrium remains fairly constant over a period of time because the loss of flavorant at the opened ends of the hollow fiber is low due to the great length to diameter ratio which makes the hollow tube appear to be closed ended. When the smoker inhales, the smoke is drawn through the filter and the lumen of the hollow fiber. A major portion of the inhaled smoke is channeled through the lumen, because it is less resistant to the flow of smoke than the filter in general, and thus high smoke to hollow fiber contact rates are achieved. The smoke becomes entrained with the flavorant and is delivered to the smoker. Once the flavorant is swept into the smoke stream, a new equilibrium between flavorant dissolved in the fiber and present in the lumen is rapidly achieved and becomes available for the smoker's next puff.

The addition of a cellulose acetate sheath is beneficial from two standpoints. First, since the flavorant is less soluble in cellulose acetate than in the thermoplastic, the cellulose acetate sheath acts as a relatively impermeable membrane that prevents release of flavorant from the exterior wall of the hollow fiber. Second, the cellulose acetate sheath facilitates bonding of the hollow fiber to the tow.

The hollow fiber is manufactured by an extrusion process. For example, see U.S. Pat. No. 4,211,741 to Sunlite Plastics of Milwaukee, WI. The hollow thermoplastic fiber which is sheathed with a layer of cellulose acetate is made by a co-extrusion process. See U.S. Pat. No. 4,211,741 to Sunlite. In general, flavored thermoplastic chips are extruded into tubular form. The flavored tubular fibers are taken up on reels and stored prior to filter rod formation. The sheath/core tubular fibers are made by a co-extrusion process with the cellulose acetate sheath surrounding the thermoplastic core.

Once flavored thermoplastic hollow fibers are made, they may be fed into a conventional rod making machine which has been modified with a funnel 10 as shown in FIG. 1. Expanded tow enters the wide end 12 of the funnel and the hollow fibers enter through a tube 14 at the side 16 of the funnel. Both the tow and fiber exit at the narrow end 18 of the funnel and proceed into the filter making machine (not shown) in a known manner.

Figure 2A:
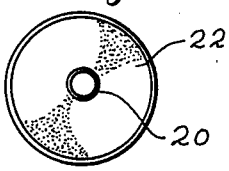
FIGS. 2–4, 2A–4A and 2B–4B illustrate alternate embodiments of a filter containing a flavored hollow fiber.
Figure 2:
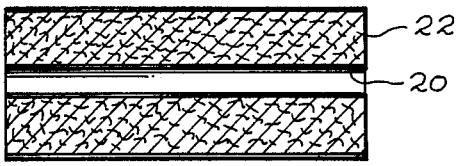
Figure 2B:
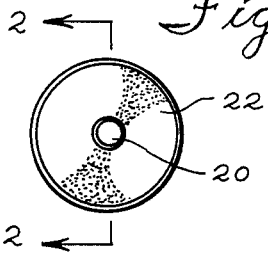
Figure 3A:
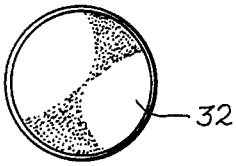
Figure 3:
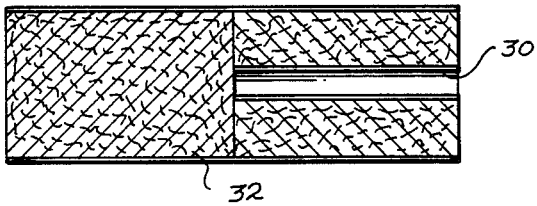
Figure 3B:
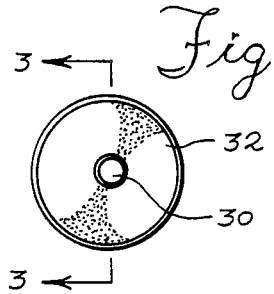
Figure 4A:
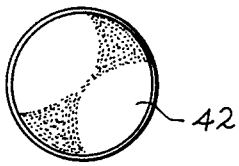
Figure 4:
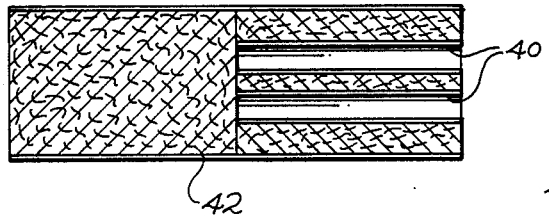
Figure 4B:
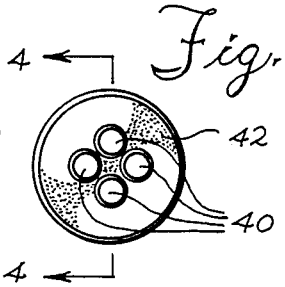

Referring to FIGS. 2–4, alternate constructions of the filter are illustrated. In FIG. 2, a single hollow fiber 20 extends throughout the entire length of the filter plug 22. The term "filter plug" as used herein refers to a filter made of cellulose acetate tow, synthetic fibers, paper, nonwoven webs, or a combination thereof. Multiple hollow fibers could also extend throughout the entire length of the filter plug. In FIG. 3, a single hollow fiber 30 is shown extending part way through the filter plug 32. In FIG. 4, multiple hollow fibers 40 are shown extending part way through the filter plug 42. These latter filters are sometimes referred to as "dual filters" and may comprise tow and web. All of these filters may be surrounded by a plug wrapper as is well known in the art.

The present invention may be embodied in other specific forms without departing from the spirit or essential attributes thereof and, accordingly, reference should be made to the appended claims, rather than the foregoing specification as indicating the scope of the invention.

In the claims:

1. A filter for a smoking article comprising:

a flavorant;

a thermoplastic hollow fiber, said flavorant dispersed within said thermoplastic of said hollow fiber; and a filter plug, said fiber embedded within said filter plug.

2. The filter according to claim 1 wherein said flavorant comprises about 5–25 percent by weight of said thermoplastic.

3. The filter according to claim 1 wherein said flavorant is selected from the group consisting of menthol, spearmint, peppermint, cocoa, vanilla, cinnamon, licorice, citrus, other fruit flavor and tobacco.

4. The filter according to claim 1 wherein said thermoplastic is selected from the group consisting of polyolefins, polyesters and polycarbonates.

5. The filter according to claim 1 wherein said thermoplastic is polyethylene.

6. The filter according to claim 1 wherein said fiber has an outside diameter of about 0.02–0.15 inches and a wall thickness of about 0.005–0.025 inches.

7. The filter according to claim 1 wherein said fiber extends throughout the entire length of said filter plug.

8. The filter according to claim 1 wherein said fiber extends part way through said filter plug.

9. The filter according to claim 1 comprises more than one hollow fiber.

10. The filter according to claim 1 wherein said hollow fiber is sheathed in a layer of cellulose acetate.

11. A filter for a smoking article comprising:

a hollow fiber made of a thermoplastic selected from the group consisting of polyolefins, polyesters and polycarbonates;

a flavorant comprising about 5–25 percent by weight of said thermoplastic and being selected from the group consisting of menthol, spearmint, peppermint, cocoa, vanilla, cinnamon, licorice, citrus, other fruit flavors, tobacco; and a filter plug, said fiber embedded within said filter plug.

12. The filter according to claim 11 wherein said hollow fiber is sheathed in cellulose acetate.

* * * * *